US008480061B2

(12) United States Patent
Graves

(10) Patent No.: US 8,480,061 B2
(45) Date of Patent: Jul. 9, 2013

(54) T-POST BRACKET ATTACHMENT SYSTEM

(76) Inventor: Thomas L. Graves, Vernon, AZ (US)

( * ) Notice: Subject to any disclaimer, the term of this patent is extended or adjusted under 35 U.S.C. 154(b) by 0 days.

(21) Appl. No.: 13/440,529

(22) Filed: Apr. 5, 2012

(65) Prior Publication Data

US 2012/0261634 A1 Oct. 18, 2012

Related U.S. Application Data

(60) Provisional application No. 61/474,665, filed on Apr. 12, 2011.

(51) Int. Cl.
*E04H 17/00* (2006.01)

(52) U.S. Cl.
USPC ... 256/65.03; 256/65.01; 29/428; 248/220.21

(58) Field of Classification Search
CPC ..... E04H 17/22; E04H 2017/1473
USPC ..... 256/32, 35, 36, 46, 56, 60, 64, 65.01, 256/65.02, 65.03, 68, 69, DIG. 5; 182/186.7, 182/186.8; 52/100, 655.1, 849, 846, 848; 248/220.22, 218.4, 200, 220.21; 403/190; 29/428, 525.01, 525.02, 525.11, 897.32
See application file for complete search history.

(56) References Cited

U.S. PATENT DOCUMENTS 3,992,118 A * 11/1976 Siegers ..... 403/171
4,763,879 A * 8/1988 Wasicek et al. ..... 256/36
4,889,322 A * 12/1989 Wagner ..... 256/36
4,936,550 A 6/1990 Wickham
5,046,705 A 9/1991 Williams
5,104,074 A * 4/1992 Malloy ..... 248/156
5,224,241 A * 7/1993 Williams ..... 16/253
5,460,344 A 10/1995 Malloy
5,518,333 A * 5/1996 Cienkus et al. ..... 403/169
5,918,700 A * 7/1999 Gregory ..... 182/186.8
6,443,433 B1 * 9/2002 Auldridge ..... 256/68
6,705,598 B2 * 3/2004 Collins ..... 256/35
6,722,471 B2 * 4/2004 Wolfe ..... 182/186.7
6,883,785 B1 * 4/2005 Knapp ..... 256/10
7,070,136 B1 * 7/2006 Bailey ..... 241/260.1

* cited by examiner

*Primary Examiner* — Daniel P. Stodola
*Assistant Examiner* — Matthew R McMahon
(74) *Attorney, Agent, or Firm* — Law Offices of Michael L. Wise, LLC

(57) ABSTRACT

A fencing system comprises a T-post, an upper sleeve, a lower sleeve, and a bracket. Both the upper sleeve and the lower sleeve encircle respective portions of the T-post. The sleeves are designed such that passing bolts through the sleeves cooperates with the lugs on the T-post in a manner that restricts the motion of the sleeves along the longitudinal axis of the T-post. The bracket, in turn, defines an upper mounting arm and a lower mounting arm. Capturing the upper mounting arm between the T-post and the upper sleeve and capturing the lower mounting arm between the lower sleeve and the T-post acts as an effective means by which to fixate the bracket to the T-post.

17 Claims, 8 Drawing Sheets

T-POST BRACKET ATTACHMENT SYSTEM

FIELD OF THE INVENTION

The present invention relates generally to apparatus and methods for erecting fences and the like.

BACKGROUND OF THE INVENTION

A T-post is a very common type of fence post in the United States. T-posts are typically made of steel and are sometimes manufactured from discarded railroad tracks. FIG. 1 shows a front perspective view of a conventional T-post 100. When viewed from an end, the T-post 100 describes an obvious T shape. Along a spine 110 of the T-post 100, there are series of equally spaced lugs 120 (i.e., nubs) that project outward from the spine 110.

T-posts may be used to support various types of wire (non-electrified or electrified), wire mesh, and rail fencing. When erecting such fencing, the T-posts are ordinarily driven into the ground with a manual or pneumatic post pounder. Flat plates attached near the bottoms of the T-posts are buried with the posts and help in keeping them upright. To address stress, bracing is frequently added to those T-posts that lie at the terminus of a fence, support a gate, or form a fence corner. Such bracing often includes tying one T-post to an adjacent T-post by one or more horizontal and/or diagonal support members.

When erecting non-electrified wire fences, the wire will most often simply be wrapped around the lugs of the T-posts so that the wire cannot slide up or down the post. However, while the lugs of the T-posts alone may be adequate for supporting non-electrified wire, some form of separate attachment means (i.e., bracket) is usually required to attach bracing to a T-post or when erecting a T-post fence with electrified wire or fence rails. Many solutions have been directed at providing brackets for use on T-posts. Three such solutions are described in, for example, U.S. Pat. No. 4,936,550 to Wickham, entitled "Universal connector for T-posts and the like"; U.S. Pat. No. 5,046,705 to Williams, entitled "Wedge for mounting fence post collars"; and U.S. Pat. No. 5,460,344 to Malloy, entitled "Fence support." However, these particular solutions, as well as the others, each suffer from one or more disadvantages, namely, difficulty of installation, inability to adapt to more than one application, complexity of manufacture, high cost, and poor attachment strength.

For the foregoing reasons, there is a need for new T-post bracket attachment systems that do not display these various disadvantages.

SUMMARY OF THE INVENTION

Embodiments of the present invention address the above-identified needs by providing fencing systems that are easy to install, are easily adapted to several different applications, are relatively easy and inexpensive to manufacture, and provide very high strength. In addition, embodiments of the invention provide effective and efficient methods of erecting a robust fence.

In accordance with an aspect of the invention, a fencing system comprises a T-post, an upper sleeve, two upper bolts, a lower sleeve, two lower bolts, and a bracket. The T-post defines a series of lugs arranged along a longitudinal axis. The upper sleeve, in turn, encircles an upper portion of the T-post. The two upper bolts pass through the upper sleeve such that respective shafts of the two upper bolts are disposed between two of the series of lugs of the T-post or on opposing sides of one of the series of lugs of the T-post in a manner that restricts the motion of the upper sleeve along the longitudinal axis of the T-post. The lower sleeve encircles a lower portion of the T-post. The two lower bolts pass through the lower sleeve such that respective shafts of the two lower bolts are disposed between two of the series of lugs of the T-post or on opposing sides of one of the series of lugs of the T-post in a manner that restricts the motion of the lower sleeve along the longitudinal axis of the T-post. The bracket defines an upper mounting arm captured between the T-post and the upper sleeve, and a lower mounting arm captured between the T-post and the lower sleeve.

In accordance with another aspect of the invention, an apparatus is provided for use with a T-post that defines a series of lugs along its longitudinal axis. The apparatus defines four holes that allow two bolts to pass through the apparatus while the apparatus encircles a portion of the T-post. In so doing, respective shafts of the two bolts can be disposed between two of the series of lugs of the T-post or on opposing sides of one of the series of lugs of the T-post in a manner that restricts the motion of the apparatus along the longitudinal axis of the T-post.

In accordance with even another aspect of the invention, a T-post defining a series of lugs along a longitudinal axis is erected. An upper sleeve is then made to encircle an upper portion of the T-post. Two upper bolts are passed through the upper sleeve such that respective shafts of the two upper bolts are disposed between two of the series of lugs of the T-post or on opposing sides of one of the series of lugs of the T-post in a manner that restricts the motion of the upper sleeve along the longitudinal axis of the T-post. In addition, a lower sleeve is made to encircle a lower portion of the T-post. Here, two lower bolts are passed through the lower sleeve such that respective shafts of the two lower bolts are disposed between two of the series of lugs of the T-post or on opposing sides of one of the series of lugs of the T-post in a manner that restricts the motion of the lower sleeve along the longitudinal axis of the T-post. A bracket is fixated to the T-post at least in part by capturing an upper mounting arm of the bracket between the T-post and the upper sleeve, and capturing a lower mounting arm of the bracket between the T-post and the lower sleeve.

BRIEF DESCRIPTION OF THE DRAWINGS

These and other features, aspects, and advantages of the present invention will become better understood with regard to the following description, and accompanying drawings where.

DETAILED DESCRIPTION OF THE INVENTION

The present invention will be described with reference to illustrative embodiments. For this reason, numerous modifications can be made to these embodiments and the results will still come within the scope of the invention. No limitations with respect to the specific embodiments described herein are intended or should be inferred.

Figure 1:
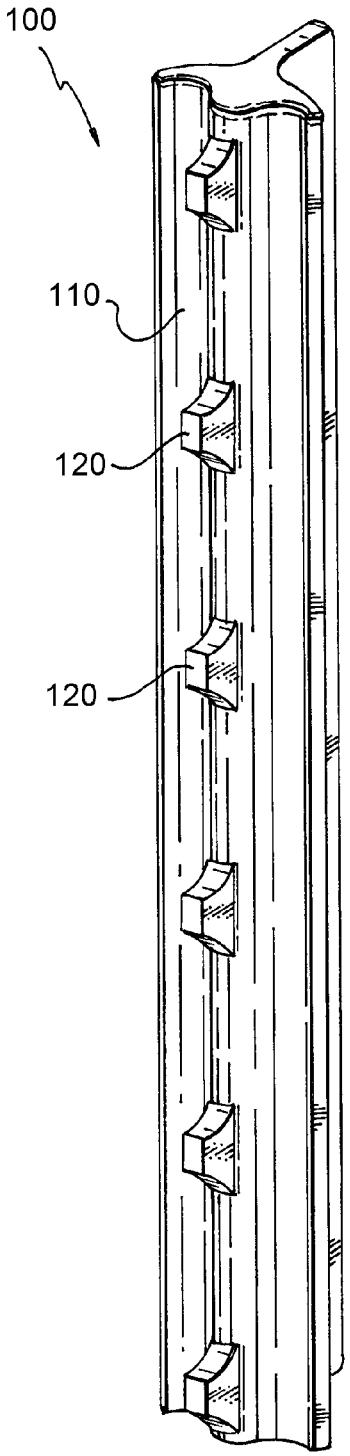
Fig. 1 (Prior Art)
FIG. 1 shows a front perspective view of a conventional T-post.
Figure 2:
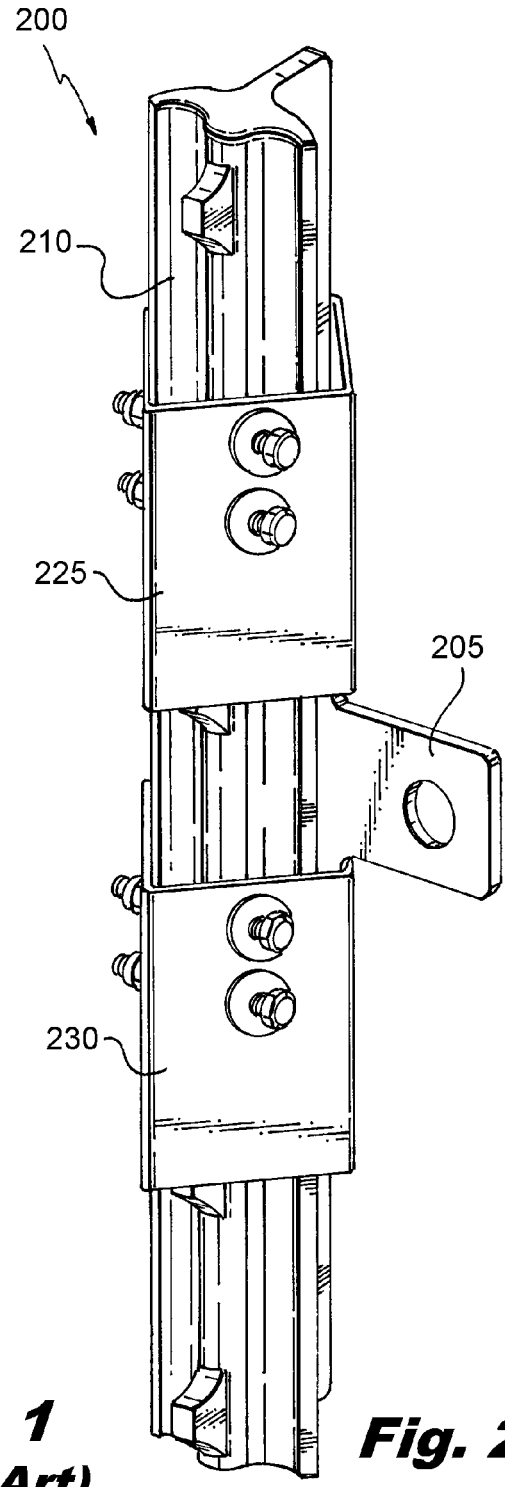
FIG. 2 shows a front perspective view of a fencing system in accordance with an illustrative embodiment of the invention.
Figure 3:
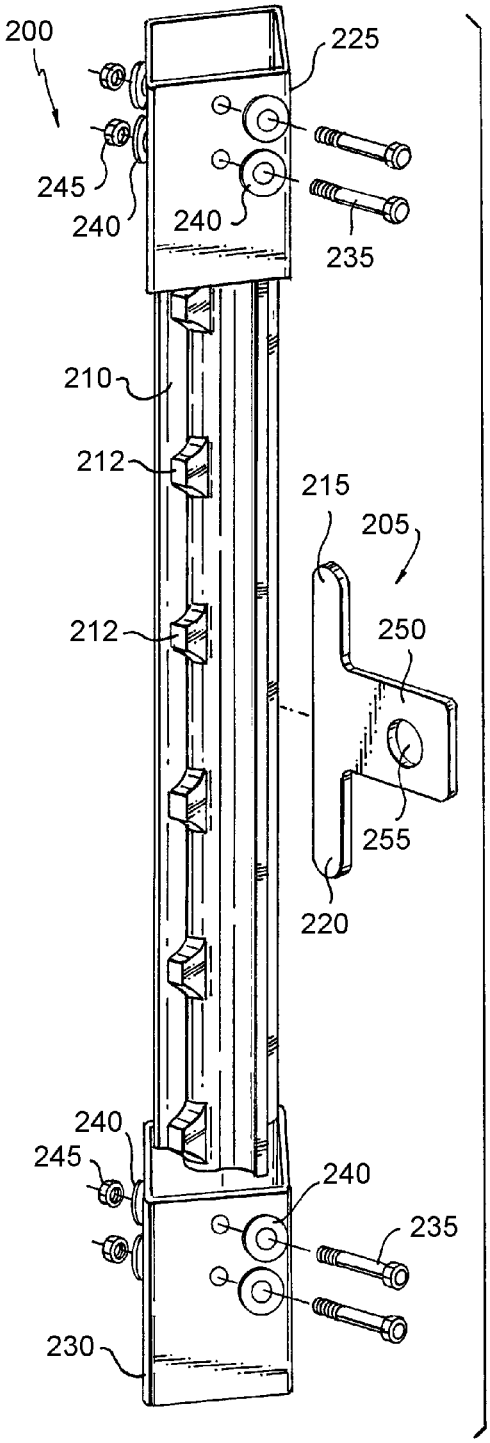
FIG. 3 shows an exploded perspective view of the FIG. 2 fencing system.

FIG. 2 shows a front perspective view of a fencing system 200 in accordance with an illustrative embodiment of the invention. FIG. 3, moreover, shows an exploded perspective view of the system 200. The system 200 comprises a bracket 205 attached to a T-post 210 having a series of lugs 212. The bracket 205 includes an upper mounting arm 215 and a lower mounting arm 220, which are captured by an upper sleeve 225 and a lower sleeve 230. The upper sleeve 225 and the lower sleeve 230 are each attached to the T-post 210 using two respective bolts 235, four respective washers 240, and two respective nuts 245. The bracket 205 further comprises a connecting arm 250 that defines an opening 255. As will be seen below, the opening 255 is a convenient means by which to attach other objects to the bracket 205 and ultimately to the T-post 210.

Figure 4:
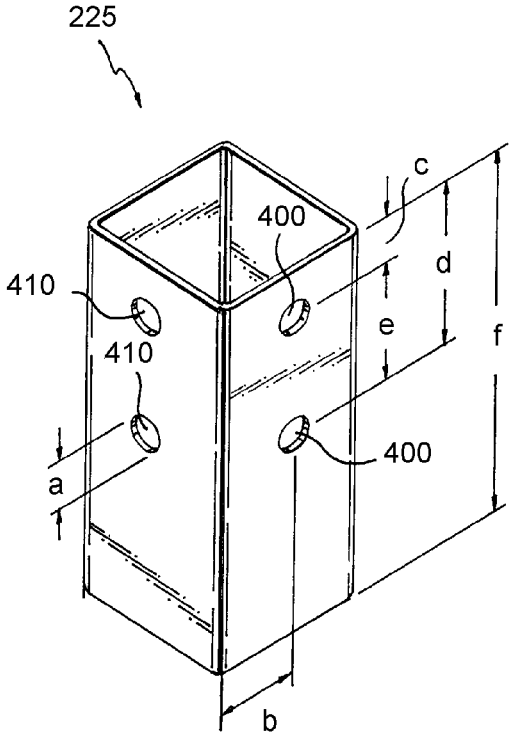
FIG. 4 shows a front perspective view of a sleeve in the FIG. 2 fencing system.

The upper and lower sleeves 225, 230 are substantially identical. Additional aspects of the upper sleeve 225 are detailed in the front perspective view shown in FIG. 4. The upper sleeve 225 comprises a portion of square tubing with a first pair of holes 400 on one flat surface and a second pair of holes 410 on an adjacent flat surface. The first pair of holes 400 is aligned with the second pair of holes 410 so that the two bolts 235 may be made to pass through the upper sleeve 225 at an oblique angle. Once fully inserted the heads and threaded ends of each of the two bolts 235 lie outside the upper sleeve 225. At the same time, the shafts of the bolts 235 pass through the inside of the upper sleeve 225 at an angle of approximately 45 degrees relative to the flat surfaces of the upper sleeve 225.

For use with conventional T-posts like the T-post 210, the upper and lower sleeves 225, 230 may have dimensions such that: a is equal to about 7/16 inches; b is equal to about 7/8 inches; c is equal to about 1/2 inches; d is equal to about 1 1/20 inches; e is equal to about 1 inch; and f is equal to about 3 inches. Nevertheless, these particular dimensions are merely illustrative and other suitable dimensions may also be utilized. With the upper and lower sleeves 225, 230 sized as indicated above, the shafts of the two bolts 235 that pass through each of the upper and lower sleeves 225, 230 will be spaced apart by about one inch. The bolts 235 may have a length of two inches and a diameter of 1/4 inches, although, again, other equally suitable sizes may be utilized.

Figure 5:
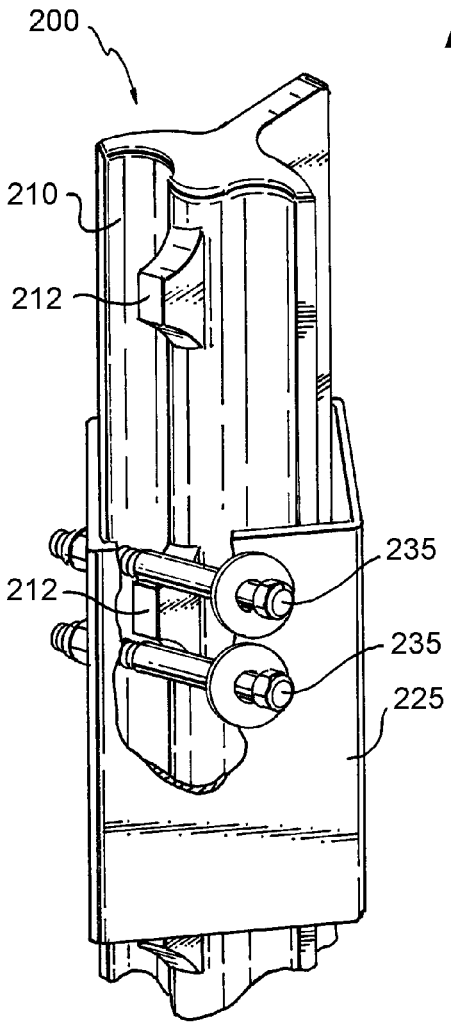
FIG. 5 shows a partially broken front perspective view of a portion of the FIG. 2 fencing system.

FIG. 5 goes on to show a partially broken front perspective view of the system 200 which helps to illustrative the manner in which the upper and lower sleeves 225, 230 are fixated to the T-post 210. The upper sleeve 225 is positioned where desired on the T-post 210, and the two bolts 235 are passed through the upper sleeve 225 and secured using four washers 240 and two nuts 245. Depending on the placement of the upper sleeve 225 on the T-post 210, the two bolts 235 will either both fall between two lugs 212 or straddle a single lug 212 (the latter being the case in FIG. 5). Notably, the bolts 235 in combination with the lugs 212 now stop the upper sleeve 225 from moving substantially upward or downward along the T-post's longitudinal axis (i.e., the lengthwise axis of the T-post 210). At the same time, the relatively loose fit of the upper sleeve 225 over the T-post 210 gives the upper sleeve 225 a limited amount of rotational freedom. The lower sleeve 230 is fixated to the T-post 210 in a similar manner.

Figure 6:
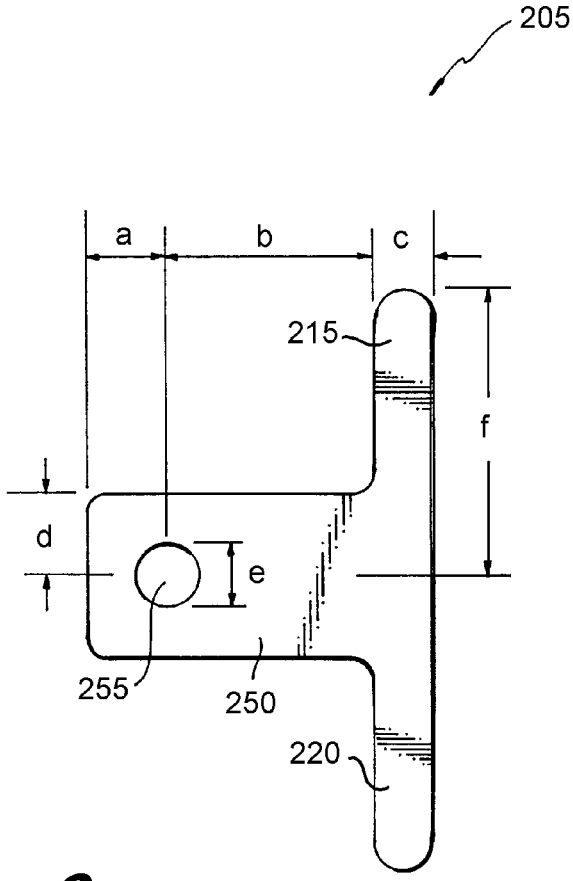
FIG. 6 shows a front elevational view of the bracket in the FIG. 2 fencing system.

FIG. 6 shows a front elevational view of the bracket 205. The bracket 205 may be sized such that, for example: a is equal to about 3/4 inches; b is equal to about 1 3/8 inches; c is equal to about 3/8 inches; d is equal to about 9/16 inches; e is equal to about 1/2 inches; and f is equal to about 2 1/8 inches. Attaching the bracket 205 to the T-post 210 to obtain the configuration shown in FIG. 2 merely requires positioning the bracket 205 where desired and attaching the lower sleeve 230 to the T-post 210 just below the bracket 205 such that the lower mounting arm 220 of the bracket 205 is captured between the lower sleeve 230 and the T-post 210. Likewise, the upper sleeve 225 is attached to the T-post 210 just above the bracket 205 so that the upper mounting arm 215 is captured between the upper sleeve 225 and the T-post 210.

Attaching the bracket 205 to the T-post 210 in this manner has several advantages. The bracket 205 may, for example, be attached to the T-post 210 almost anywhere along the T-post's longitudinal axis. Because of the manner in which the bracket 205 is attached to the T-post 210, the bracket 205 is also free to swivel about the T-post's longitudinal axis by about 30-45 degrees. This has the benefit of allowing external objects to be attached to the T-post 210 from almost any angle.

Figure 7:
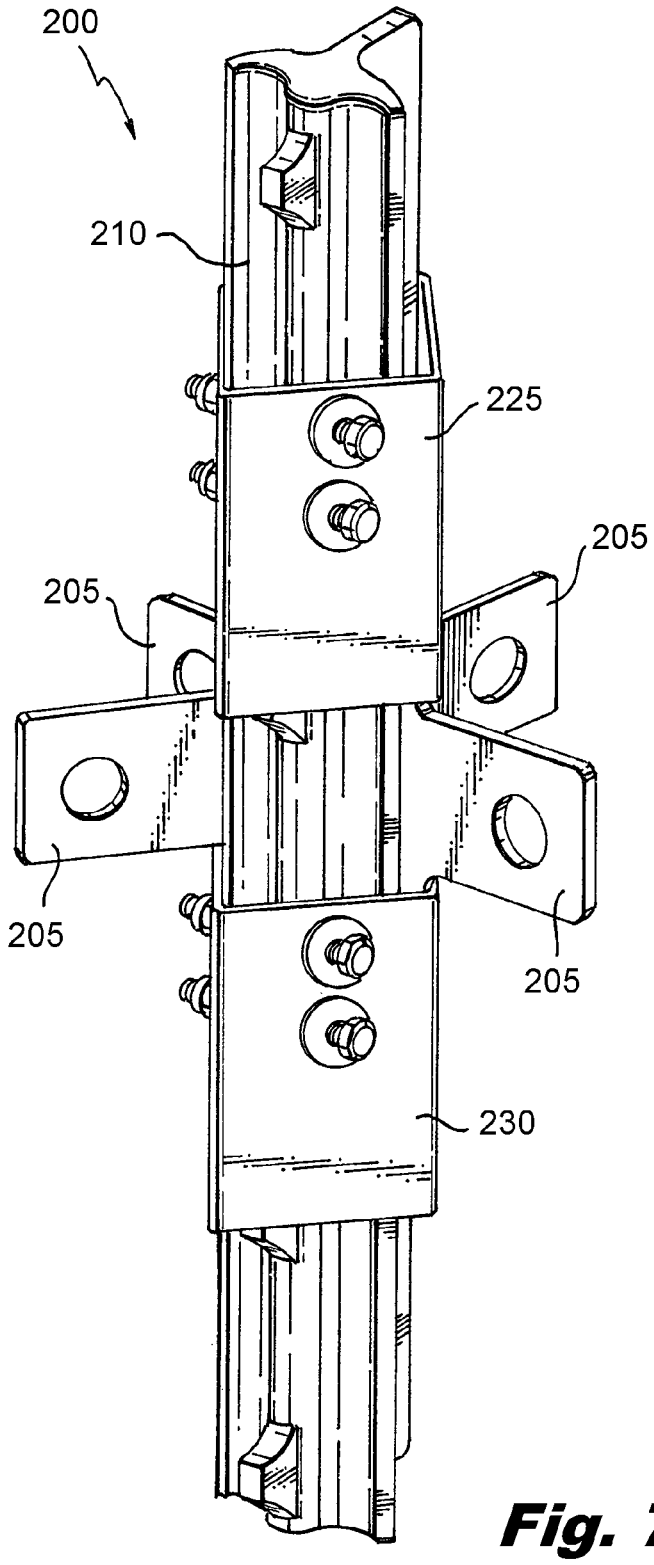
FIG. 7 shows a front perspective view of four brackets attached to a T-post in the FIG. 2 fencing system.

In addition, more than one bracket 205 can be captured by a single set of upper and lower sleeves 225, 230, thereby allowing several brackets 205 to be placed at a single point along the longitudinal axis of the T-post 210. FIG. 7 shows a front perspective view of four brackets 205 attached to the T-post 210 using the upper sleeve 225 and the lower sleeve 230.

Figure 8:
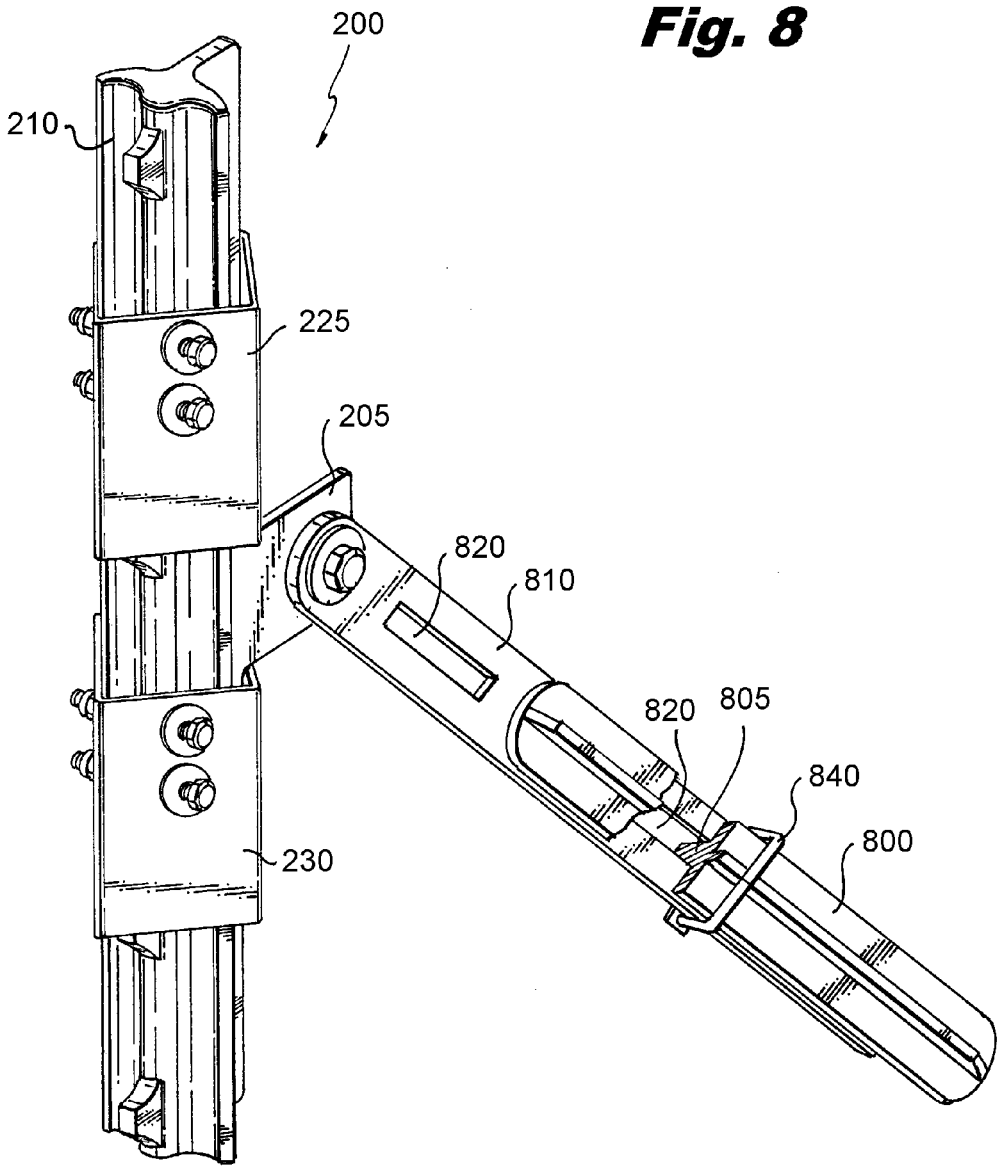
FIG. 8 shows a partially broken front perspective view of the FIG. 2 fencing system with the addition of a bracing T-post and an extension bar.

As indicated earlier, bracing a T-post often includes tying that T-post to an adjacent T-post by one or more horizontal and/or diagonal support members (i.e., bracing members). FIG. 8 shows a partially broken front perspective view of an optional means for accomplishing this bracing in combination with the above-described bracket 205, T-post 210, and sleeves 225, 230. The optional means utilizes a separate bracing T-post 800 with lugs 805 in combination with an extension bar 810 to create a unique bracing member. The resulting bracing member is both easy to utilize and extremely strong.

Figure 9:
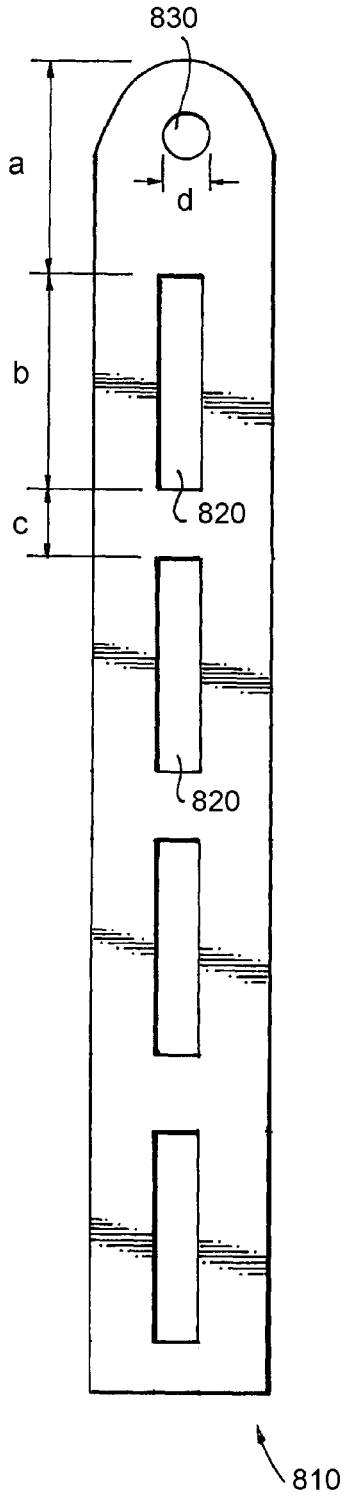
FIG. 9 shows a front elevational view of the FIG. 8 extension bar.

Particulars of the extension bar 810 in accordance with aspects of the invention are shown in the front elevational view in FIG. 9. The extension bar 810 defines a series of slots 820 along its longitudinal axis and a hole 830 at one of its ends. The slots 820 in the extension bar 810 are sized and spaced so that lugs 805 from the bracing T-post 800 may be made to fall within the slots 820 when the extension bar 810 is aligned with and placed against a spine of the bracing T-post 800. In one or more non-limiting embodiments, the extension bar 810 may have dimensions such that: a is equal to about 1 7/16 inches; b is equal to about 1 11/16 inches; and c is equal to about 9/16 inches. The extension bar 810 can be placed so that between one and four lugs 805 from the bracing T-post 800 fall within the slots 820 of the extension bar 810, thereby allowing the total length of the resultant bracing member to be varied. Once in its correct position, the extension bar 810 may be held firmly against the bracing T-post 800 by a conventional U-bolt 840 (FIG. 8).

Figure 10:
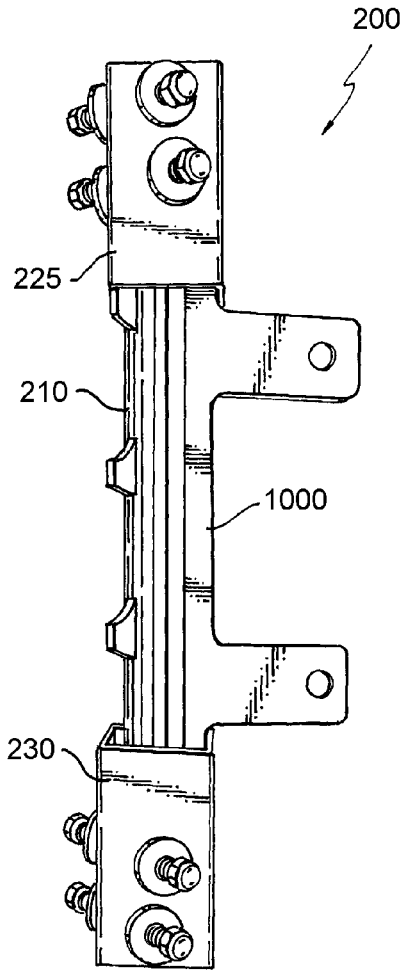
FIG. 10 shows a front perspective view of the FIG. 2 fencing system with the addition of an alternative bracket.
Figure 11:
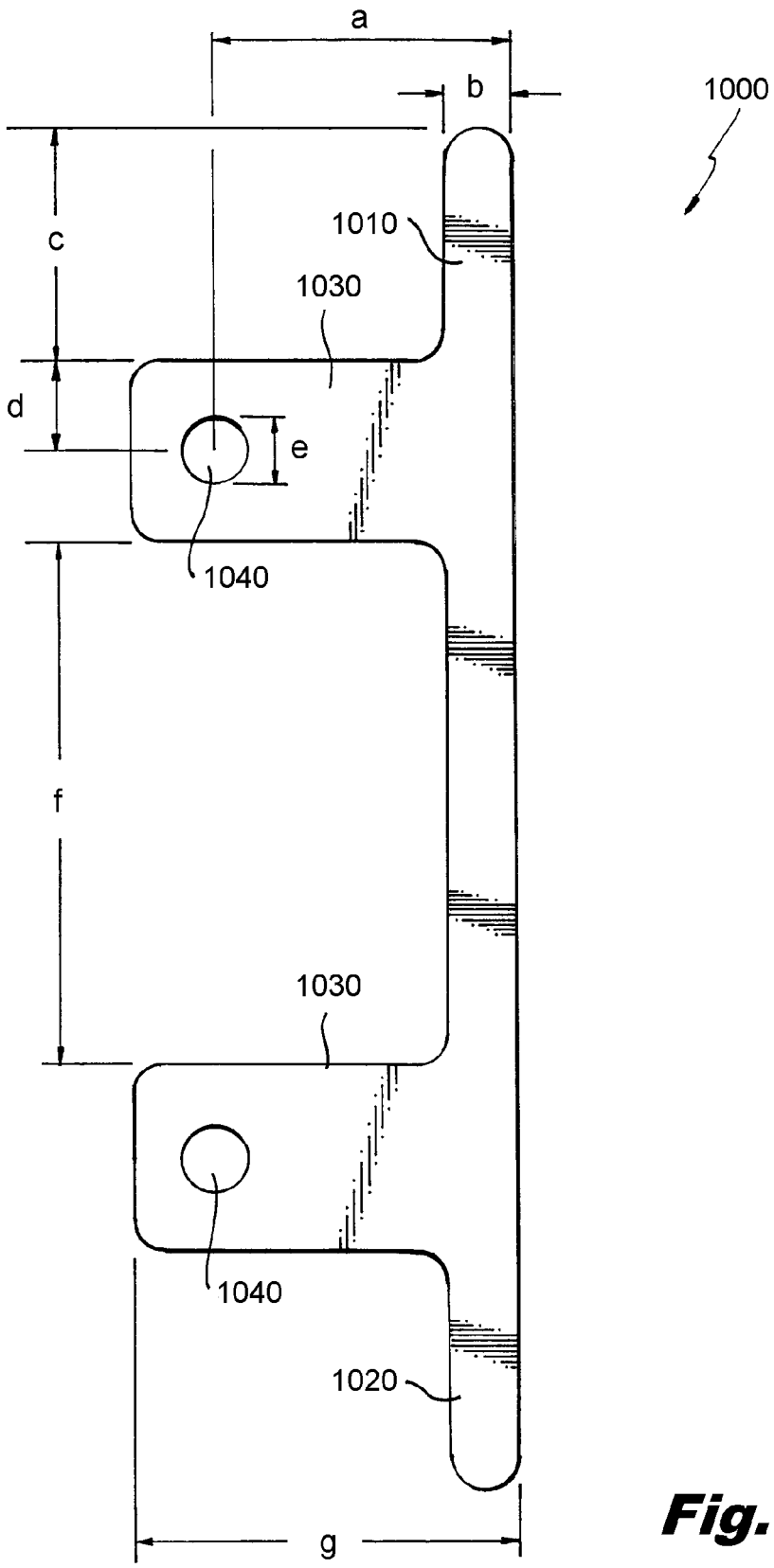
FIG. 11 shows a front elevational view of the FIG. 10 alternative bracket.
Figure 12:
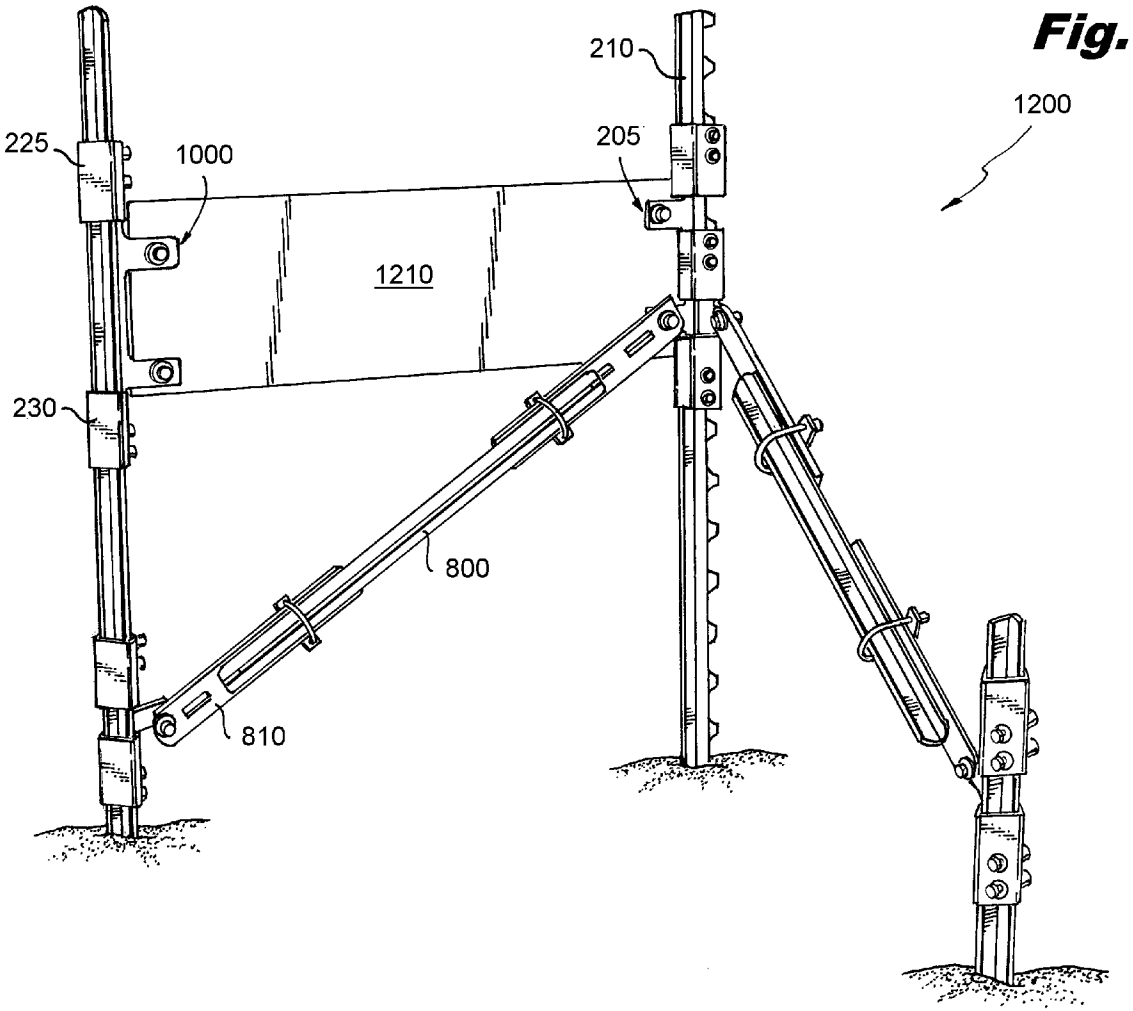
FIG. 12 shows a front perspective view of a fencing system in accordance with aspects of the invention supporting a fence rail.

The bracket 205 is merely one illustrative design and many other forms of brackets may be utilized in accordance with aspects of the invention. FIG. 10 shows a front perspective view the system 200 with an alternative bracket 1000. FIG. 11, moreover, shows a front elevational view of the alternative bracket 1000. Like the bracket 205, the alternative bracket 1000 includes an upper mounting arm 1010 and a lower mounting arm 1020, which may be captured by the upper sleeve 225 and the lower sleeve 230, respectively. But, in contrast to the bracket 205, the alternative bracket 1000 comprises two connecting arms 1030, each connecting arm 1030 defining a respective opening 1040. The two connecting arms 1030 and their respective openings 1040 may, for example, provide a convenient means by which to attach fence rails between two T-posts. In one or more non-limiting embodiments, for example, the alternative bracket 1000 may be sized such that: a is equal to about 1⅞ inches; b is equal to about ⅜ inches; c is equal to about 1½ inches; d is equal to about ⅝ inches; e is equal to about ½ inches; f is equal to about 3⅝ inches; and g is equal to about 2⁷⁄₁₆ inches. A fencing system 1200 with the inclusion of an alternative bracket 1000 and a fence rail 1210 is shown in the perspective view in FIG. 12. The fencing system 1200 also utilizes several of the elements described above, many of which are labeled by like reference numerals.

Advantageously, once the novel aspects of the invention are understood, its components may be readily formed utilizing ordinary manufacturing techniques or easily sourced from commercial vendors. The sleeves 225, 230 may, for example be formed from ¹⁄₁₆-inch thick steel square tubing in the manner indicated above, while the various brackets may be formed from ¼-inch thick sheets of steel utilizing conventional plasma or water-jet cutting technologies. Once so formed, these components may be dipped in a protective paint to increase their resistance to corrosion. The remaining T-posts 210, bolts 235, washers 240, nuts 245, and U-bolts 840 are entirely conventional and may be sourced from many hardware stores.

It should again be emphasized that the above-described embodiments of the invention are intended to be illustrative only. Other embodiments can use different types, arrangements, and sizes of elements for implementing the described functionality. As one example, aspects of the invention may be adapted for the purpose of supporting a swinging fence gate. These numerous alternative embodiments within the scope of the invention will be apparent to one skilled in the art.

Moreover, all the features disclosed herein may be replaced by alternative features serving the same, equivalent, or similar purposes, unless expressly stated otherwise. Thus, unless expressly stated otherwise, each feature disclosed is one example only of a generic series of equivalent or similar features.

Any element in a claim that does not explicitly state "means for" performing a specified function or "step for" performing a specified function is not to be interpreted as a "means for" or "step for" clause as specified in 35 U.S.C. §112, ¶6. In particular, the use of "step of" in the claims herein is not intended to invoke the provisions of 35 U.S.C. §112, ¶6.

What is claimed is:

1. A fencing system, the fencing system comprising:

a T-post, the T-post defining a series of lugs arranged along a longitudinal axis;

an upper sleeve, the upper sleeve completely encircling an upper portion of the T-post;

two upper bolts, the two upper bolts passing through the upper sleeve such that respective portions of the two upper bolts are disposed between two lugs of the series of lugs of the T-post or on opposing sides of one lug of the series of lugs of the T-post in a manner that restricts the motion of the upper sleeve along the longitudinal axis of the T-post;

a lower sleeve, the lower sleeve completely encircling a lower portion of the T-post;

two lower bolts, the two lower bolts passing through the lower sleeve such that respective portions of the two lower bolts are disposed between two lugs of the series of lugs of the T-post or on opposing sides of one lug of the series of lugs of the T-post in a manner that restricts the motion of the lower sleeve along the longitudinal axis of the T-post; and a bracket, the bracket defining an upper mounting arm captured between the T-post and the upper sleeve, and a lower mounting arm captured between the T-post and the lower sleeve.

2. The fencing system of claim 1, wherein the upper sleeve is substantially square tubular or substantially rectangular tubular.

3. The fencing system of claim 1, wherein the upper sleeve defines a first upper flat surface and a second upper flat surface, the second upper flat surface being adjacent to the first upper flat surface, and wherein one of the two upper bolts passes through the upper sleeve by entering the upper sleeve through the first upper flat surface and exiting the upper sleeve through the second upper flat surface.

4. The fencing system of claim 1, wherein the lower sleeve is substantially square tubular or substantially rectangular tubular.

5. The fencing system of claim 1, wherein the lower sleeve defines a first lower flat surface and a second lower flat surface, the second lower flat surface being adjacent to the first lower flat surface, and wherein one of the two lower bolts passes through the lower sleeve by entering the lower sleeve through the first lower flat surface and exiting the lower sleeve through the second lower flat surface.

6. The fencing system of claim 1, wherein the bracket can be manually swiveled about the longitudinal axis of the T-post by at least about 30 degrees.

7. The fencing system of claim 1, wherein the bracket further defines a connecting arm, the connecting arm defining a hole therein.

8. The fencing system of claim 7, wherein the upper mounting arm, the lower mounting arm, and the connecting arm of the bracket are arranged in a T-shape with respect to one another.

9. The fencing system of claim 1, further comprising a second bracket, the second bracket defining a second upper mounting arm captured between the T-post and the upper sleeve, and a second lower mounting arm captured between the T-post and the lower sleeve.

10. The fencing system of claim 1, wherein the bracket further comprises two connecting arms, each of the two connecting arms defining a respective hole therein.

11. The fencing system of claim 1, further comprising an extension bar attached to the bracket, the extension bar defining an elongate bar with a series of slots defined therein.

12. The fencing system of claim 11, further comprising a second T-post, the second T-post defining a front face with a second series of lugs arranged thereon, wherein the front face is pressed against the extension bar such that one or more lugs of the second series of lugs on the second T-post engages one or more slots of the series of slots in the extension bar.

13. The fencing system of claim 12, wherein the second T-post is fixated to the extension bar at least in part utilizing a U-bolt.

14. The fencing system of claim 1, further comprising a fence rail, the fence rail supported at least in part by the bracket.

15. The fencing system of claim 1, wherein the upper sleeve and the lower sleeve are each unitary.

16. A method of erecting a fence, the method comprising the steps of:

erecting a T-post, the T-post defining a series of lugs arranged along a longitudinal axis;

completely encircling an upper portion of the T-post with an upper sleeve;

passing two upper bolts through the upper sleeve such that respective portions of the two upper bolts are disposed between two lugs of the series of lugs of the T-post or on opposing sides of one lug of the series of lugs of the T-post in a manner that restricts the motion of the upper sleeve along the longitudinal axis of the T-post;

completely encircling a lower portion of the T-post with a lower sleeve;

passing two lower bolts through the lower sleeve such that respective portions of the two lower bolts are disposed between two lugs of the series of lugs of the T-post or on opposing sides of one lug of the series of lugs of the T-post in a manner that restricts the motion of the lower sleeve along the longitudinal axis of the T-post; and fixating a bracket to the T-post at least in part by capturing an upper mounting arm of the bracket between the T-post and the upper sleeve, and capturing a lower mounting arm of the bracket between the T-post and the lower sleeve.

17. The method of claim 16, wherein the upper sleeve and the lower sleeve are each unitary.

* * * * *